United States Patent [19]

Hart

[11] 4,047,666

[45] Sept. 13, 1977

[54] JET OR SPRAY PRODUCING APPARATUS

[76] Inventor: Bernard Eaton Hart, Rosebank, Stoford, Salisbury, Wiltshire, England

[21] Appl. No.: 624,063

[22] Filed: Oct. 20, 1975

[30] Foreign Application Priority Data

June 18, 1975 United Kingdom ..... 26034/75

[51] Int. Cl.[2] ..... B05B 3/06

[52] U.S. Cl. ..... 239/251; 401/289

[58] Field of Search ..... 239/251, 252, 258, 261, 239/311, 399, 351, 369-371; 114/222; 15/50 R, 52, 29, 98, 387, 345; 401/15, 288, 289

[56] References Cited

U.S. PATENT DOCUMENTS

| | | | |
|---|---|---|---|
| 960,393 | 6/1910 | Peters | 239/251 X |
| 2,494,893 | 1/1950 | Meyers | 239/251 X |
| 2,695,773 | 11/1954 | McGrath | 239/251 X |
| 3,428,131 | 2/1969 | Winslow | 239/251 X |
| 3,441,086 | 4/1969 | Barnes | 239/251 X |
| 3,558,057 | 1/1971 | Akhmedov et al. | 239/261 |
| 3,748,050 | 7/1973 | Poppitz | 239/251 X |

*Primary Examiner*—John J. Love
*Attorney, Agent, or Firm*—Brisebois & Kruger

[57] ABSTRACT

In apparatus for producing a rotating jet or spray of fluid, e.g. water for cleaning purposes, a nozzle for producing the jet or spray is mounted for rotation about a first axis and is arranged with the axis of the nozzle spaced from the first axis and inclined thereto such that fluid leaving the nozzle will exert a force on the nozzle tending to rotate it about the first axis, and means are provided driven by the nozzle for causing a flow of the medium in which the apparatus is situated such as will generate a force on the apparatus in the direction of the first axis.

14 Claims, 4 Drawing Figures

JET OR SPRAY PRODUCING APPARATUS

The present invention relates to self motivating rotating fluid jet or spray producing apparatus and particularly to apparatus of this type in which the jet or spray is directed towards a surface, e.g. for cleaning the surface on which the apparatus is supported.

According to the present invention there is provided an apparatus for producing a rotating jet or spray of fluid to be directed against a surface, the apparatus comprising a nozzle for producing the jet or spray of fluid, means for connecting the nozzle to a supply of fluid under pressure, means mounting the nozzle for rotation about a first axis spaced from the axis of the nozzle and which first axis is, in use, substantially perpendicular to the surface, the nozzle axis being inclined relative to the first axis such that fluid leaving the nozzle will exert a force on the nozzle tending to rotate it about the first axis, and means driven by the nozzle for causing a flow of the fluid medium in which the apparatus is situated such as will generate a force on the apparatus in the direction of the first axis.

The force generating means may be arranged to generate a force tending to support the apparatus above the surface or a force tending to apply the apparatus to the surface and may comprise an elongate member extending radially of the first axis and rotatable about the first axis by rotation of the nozzle and in a radially extending chamber.

The present invention will be more fully understood from the following description of embodiments thereof, given by way of example only, with reference to the accompanying drawings.

Figure 1:
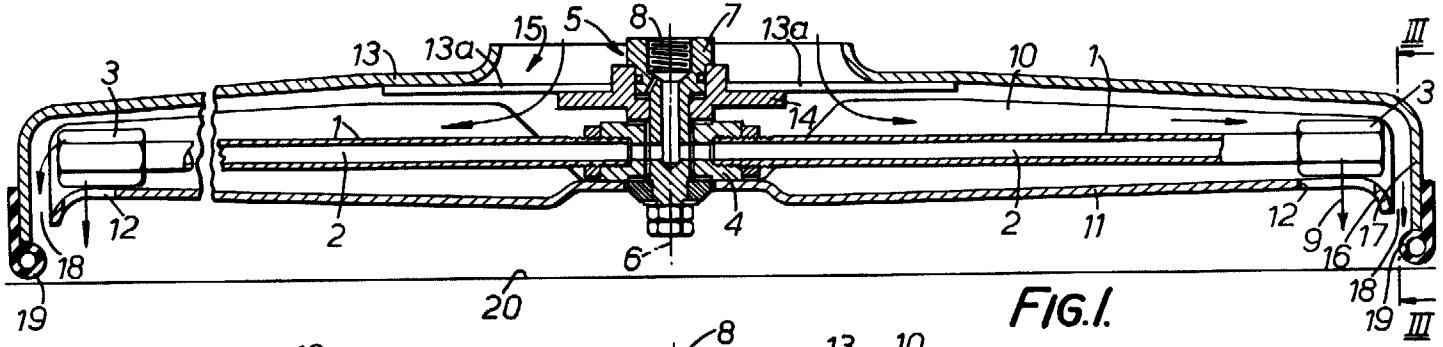
FIG. 1 is a vertical diametrical section through one embodiment according to the present invention.
Figure 3:
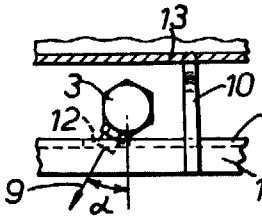
FIG. 3 is a sectional view on the line III—III of FIG. 1.
Figure 2:
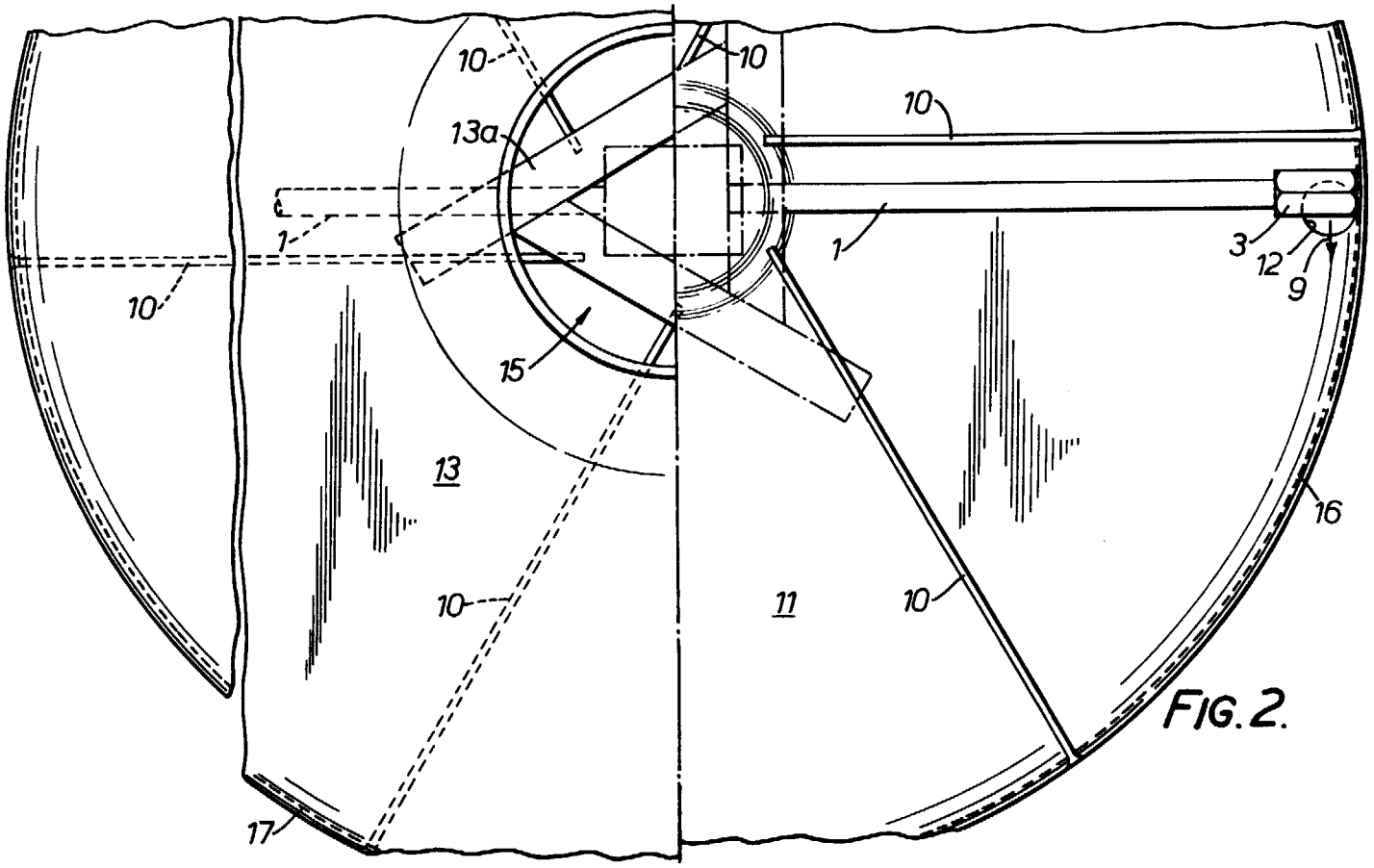
FIG. 2 is a part plan view of the apparatus of FIG. 1 with parts broken away.

As shown in FIGS. 1 to 3, the apparatus comprises a plurality of, as shown, two equally angularly spaced radial arms 1. Each arm 1 is formed with a passageway 2 therethrough connected at the outer end to a nozzle 3 and at the inner end to the rotatable part 4 of a coupling 5, which is preferably as described in U.S. Pat. No. 3,950,045, and has an axis of rotation 6. A relatively fixed part 7 of the coupling 5 has an inlet 8 for connection to a source of fluid under pressure (not shown). As an example, the inlet 8 may be connected via a short piece of flexible hose to a metal tube which is in turn rigidly connected to an on-off valve connected by a flexible hose to a high pressure fluid, e.g. water, supply, the valve serving the function of a handle by which movement of the apparatus can be controlled.

The axis 9 of each nozzle 3 extends in a plane parallel to the axis 6 and is inclined to the axis 6 and to the plane of rotation of the nozzle by an angle $\alpha$ such that fluid exiting from each nozzle will exert a force on that nozzle tending to rotate it, and therefore its arm 1, about axis 6. The speed of rotation of the nozzles will depend on the pressure of the input fluid and the angle of inclination of the nozzle.

The arms 1 rotate in a radially extending chamber which is defined by cover means comprising a relatively fixed radially extending upper cover member 13, mounted by a bracket 13*a* on a fixed part 14 of the coupling 5, and a radially extending lower cover member 11, fixed on the rotatable part 4 of the coupling 5 for rotation with the arms 1 and nozzles 3. The lower cover member 11 is provided with openings 12 aligned with the nozzle axes 9 for passage therethrough of the jets or sprays from the nozzles.

For reasons which will appear, the upper cover member 13 defines an axial air inlet 15 and the cover member 11 and 13 together define a peripheral annular axially directed outlet 18 between the circumferential margin 16, 17 thereof. The margin 17 of the upper cover member 13 extends below that of the cover member 11 and is provided with a replaceable seal 19 which may be as shown or in the form of a brush.

The apparatus also includes means causing movement of air through the chamber such as will support the apparatus above a surface 20. As shown these means comprise a plurality of, e.g. six, equally angularly spaced radially extending blades 10 mounted on the lower cover member 11.

In operation, the apparatus is placed on the surface 20, e.g. that of a runway or of a paper machine felt, which is to be cleaned with fluid and the fluid under pressure is supplied to the nozzle. The arms 1 consequently rotate causing the blades 10 to rotate, which in turn causes air to flow radially outwardly across the chamber from the inlet 15 to the outlet 18 where it forms an axially directed annular jet of air which fills the space between the lower cover member 11 and the surface 20 with air under pressure. The apparatus is thus supported above the surface 20 by the cushion of air which develops under the lower cover 11. In a modification, the apparatus could be supported simply by the thrust of the annular air jet.

Because the apparatus is supported above the surface by the air, it is easy to control and less susceptible to malfunctioning than apparatus which is mechanically supported on the surface. Futhermore angular speed control of the apparatus, such as is described in the above referred to patent application, is found to be unnecessary because the air pump will absorb excess energy which would otherwise increase the angular speed of the apparatus. Thus all that is required is that the angular inclination of the nozzles should be pre-set depending on the pressure of the fluid to be supplied to the apparatus and to give the desired angular speed.

In a particular embodiment, the upper cover member and lower cover member with blades are made of powder moulded high density polythene and are an ⅛inch to 3/16 inch thick. The input water is supplied to the apparatus at a pressure of 3,000 p.s.i. and the apparatus is designed for an angular speed of between about 200 to 300 r.p.m. With such an angular speed sufficient air flow is established to support the apparatus above the surface 20.

Figure 4:
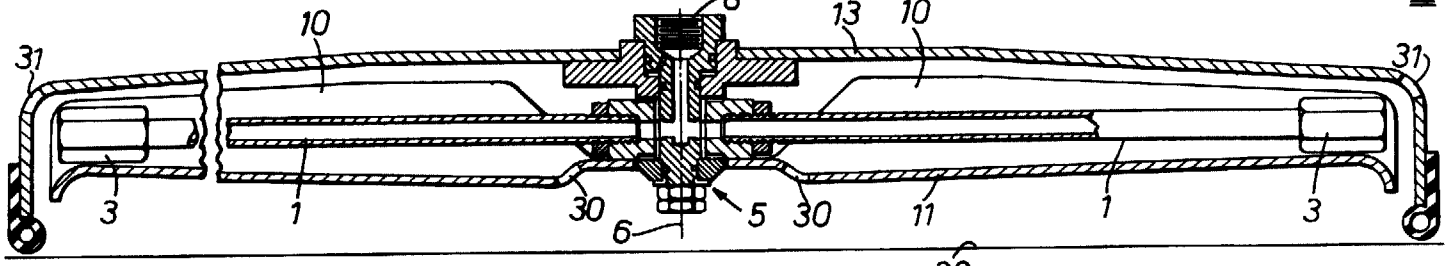
FIG. 4 is a vertical diametrical section through another embodiment according to the present invention.

In self motivating rotary fluid jet or spray producing apparatus, for example as described in the above referred to U.S. Pat. No. 3,950,045, there may be a not inconsiderable reaction provided by the jets or sprays on the apparatus along the rotary axis and in a direction tending to move the apparatus away from the surface against which the fluid jet or spray impinges. While this reaction is immaterial when the first axis is vertical, the reaction may be intolerable when the first axis is inclined to the vertical, e.g. horizontal. For example, in the case where the apparatus is used to clean a ships hull, the reaction could make the apparatus unmanageable, particularly if cleaning is effected under water. This difficulty is overcome in the apparatus shown in FIG. 4, which is very similar to that shown in FIGS. 1 to 3, but is designed such that the flow of air produced is used to counteract the axial reaction of the jets or sprays against the surface 20, rather than, as in the apparatus of FIGS. 1 to 3, to supplement the axial reaction. For convenience, the same reference numerals are used in FIG. 4 as are used in FIGS. 1 to 3 for similar parts and no further description will be given of such parts. The apparatus shown in FIG. 4 is primarily for operation in a gaseous medium, e.g. air. The air inlet to the chamber is provided adjacent the centre in the rotatable cover member 11 and the air outlet is provided adjacent the periphery of the chamber in the fixed cover member 13. To this end a plurality of angularly spaced inlet apertures 30 are formed adjacent the centre in the cover member 11, the cover member 13 centrally engaging the coupling 5 (the inlet 15 being thereby omitted) and a plurality of angularly spaced outlet apertures 31 are formed adjacent the periphery in the cover member 13.

Thus when the arms 1 rotate and rotate the blades 6, fluid is drawn into the chamber between the cover members 11, 13 through apertures 30 from the space between the surface 20 and the cover member 11. Fluid is ejected from the chamber via apertures 31. Thus a reduced pressure is created adjacent the surface 20 to tend to apply the apparatus to the surface. The apparatus is designed so that this reduced pressure at least in part and preferably wholly counteracts the axial reaction provided by the jets or sprays from the nozzles and may be sufficient to positively hold the apparatus against the surface 20.

The margin of the cover member 11 may, as shown in FIG. 4, be provided with a seal 19 or may be provided with rollers (not shown) to assist movement of the apparatus along the surface 20.

For underwater operation, the blades 6 can be omitted and the flow of fluid through the chamber between the cover members 11, 13 is obtained by the action of the arms 1 on the water in the chamber. The arms 1 cause the water in the chamber to rotate and flow outwardly under the centrifugal effect, the water leaving the chamber through the peripheral outlets 31, water being drawn into the chamber by the central inlets 30 from the space between the cover member 11 and the surface 20 so as to reduce the pressure in this space. In this embodiment, the outlets 31 may conveniently be positioned on the axially extending peripheral wall portion of the cover member 13, rather than, as shown, in the corner between the axial and radial wall portions.

It will be appreciated that the above difference between apparatus for air and water operation arises because of the difference in densities of air and water and with different designs of the blades and/or arms, no additional blades as such may be needed for air operation and blades may be needed for water operation. The basic requirement of the apparatus, as previously stated, is that as a result of rotation of the nozzles there should be a flow of the medium in which the apparatus is operating such as will create an axial force on the apparatus. This flow of medium can be obtained as a direct result of rotation of the arms or indirectly by other means, such as blades, which are rotated by the arms. The axial force may be created by increasing or reducing the pressure in the space between the lower cover member and the surface on which the apparatus is operating or by the thrust of jets of the medium.

What is claimed is:

1. Apparatus for producing a rotating jet surface-treating fluid to be directed against a surface perpendicular to the axis of rotation of the jet, said apparatus comprising:

a nozzle directed along a first axis and adapted to produce a jet of surface-treating fluid along said axis;

means for connecting said nozzle to a supply of surface-treating fluid under pressure;

means mounting said nozzle for rotation about a second axis spaced from said nozzle axis, said second axis being perpendicular to the surface and said nozzle axis being inclined to said second axis so that fluid leaving said nozzle will exert a force on said nozzle which will rotate said nozzle about said second axis;

casing means defining a chamber generally coaxial with said second axis and in which said nozzle will rotate, said casing means defining an opening through which said rotating jet from said nozzle will emerge and comprising first and second cover members extending radially of said second axis and axially delimiting said chamber, said second cover member being positioned between said surface and said first cover member when said jet is directed against said surface, and a peripheral member peripherally delimiting said chamber;

skirt means extending axially from said casing means to peripherally enclose a space into which said jet will emerge from said opening, said space being axially delimited by said second cover member and said surface;

said casing means defining axial aperture means in the region of said second axis and peripheral aperture means in the region of said periphery of said chamber, one of said aperture means communicating with said space and the other of said aperture means communicating with the exterior of said apparatus;

rotary fluid impeiler means in said chamber for driving a pressure-changing fluid through said chamber from said axial aperture means to said peripheral aperture means for changing the pressure in said space relative to the pressure on the exterior of said apparatus; and means mounting said rotary fluid impeller means for rotation by and with said nozzle.

2. Apparatus as claimed in claim 1 in which said peripheral aperture means leads to said space and said axial aperture means leads to the exterior of said casing outside said space, so that the flow of said pressure-changing fluid tends to support said apparatus above said surface.

3. Apparatus as claimed in claim 1 in which said axial aperture means leads to said space and said peripheral aperture means leads to the exterior of said casing outside said space, so that the flow of said pressure-changing fluid tends to apply said apparatus to said surface.

4. Apparatus as claimed in claim 1 in which said impeller means is a blade.

5. Apparatus as claimed in claim 1 in which said impeller means is formed by a member supporting the nozzle.

6. Apparatus as claimed in claim 1 in which said second cover member is mounted for rotation with the nozzle and the outer cover member is stationary.

7. Apparatus as claimed in claim 1 in which said impeller means comprises at least two angularly spaced propelling members.

8. Apparatus as claimed in claim 1, including at least two equally angularly spaced nozzles.

9. An apparatus for producing a rotating jet of fluid to be directed against a surface, the apparatus comprising a nozzle for producing the jet or spray of fluid, means for connecting the nozzle to a supply of fluid under pressure, means mounting the nozzle for rotation about a first axis spaced from the axis of the nozzle and which first axis is substantially perpendicular to the surface when said jet is directed against said surface, the nozzle axis being inclined relative to the first axis such that fluid leaving the nozzle will exert a force on the nozzle tending to rotate it about the first axis, and means driven by the nozzle for causing a flow of the fluid medium in which the apparatus is situated such as will generate a force on the apparatus in the direction of the first axis, said force generating means comprising at least one elongate propelling member extending radially of the first axis and rotatable about the first axis by rotation of the nozzle for propelling the medium radially outwardly thereof, and cover means defining a radially extending chamber in which said elongate means extend and having inlet and outlet means for the medium, said cover means comprising inner and outer generally radially extending cover members, of which the inner member will, in use, be positioned between the propelling member and the surface.

10. Apparatus as claimed in claim 9, wherein the inlet means is provided centrally in the outer cover member and the outlet means is provided adjacent the periphery of the cover means and is axially directed towards the surface.

11. Apparatus as claimed in claim 9, wherein the inlet means is provided centrally in the outer cover member and the outlet means are provided adjacent the periphery of the cover means and communicate with a space between the inner cover member and the surface, which space is peripherally defined by an axial extension of the cover means.

12. Apparatus as claimed in claim 11, wherein the outer cover member includes an axially directed annular peripheral portion peripherally defining the chamber, the outlet means being provided by an annular gap between the periphery of the inner cover member and the peripheral portion of the outer cover member.

13. Apparatus as claimed in claim 9, wherein the inlet means is provided centrally in the inner cover member and communicates with a space between the inner cover member and the ground, which space is peripherally defined by an axial extension of the cover means, and the outlet means are provided in the periphery of the cover means.

14. Apparatus as claimed in claim 13, wherein the outer cover member includes an axially directed annular peripheral portion peripherally defining the chamber, the outlet means being provided in a peripheral portion thereof.

* * * * *